US008614655B2

(12) United States Patent
Park

(10) Patent No.: US 8,614,655 B2
(45) Date of Patent: Dec. 24, 2013

(54) PIXEL CIRCUIT AND ORGANIC LIGHT EMITTING DIODE DISPLAY DEVICE USING THE SAME

(75) Inventor: Joon-Young Park, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1388 days.

(21) Appl. No.: 11/644,324

(22) Filed: Dec. 20, 2006

(65) Prior Publication Data

US 2007/0139314 A1 Jun. 21, 2007

(30) Foreign Application Priority Data

Dec. 20, 2005 (KR) ..... 10-2005-0126353

(51) Int. Cl.
*G09G 3/30* (2006.01)

(52) U.S. Cl.
USPC ..... 345/76; 313/498; 313/500; 345/78; 345/80; 345/82; 315/169.3; 315/169.1

(58) Field of Classification Search
USPC ..... 345/76–83; 313/498–506; 315/167–169.3
See application file for complete search history.

(56) References Cited

U.S. PATENT DOCUMENTS

| | | | | |
|---|---|---|---|---|
| 6,839,057 | B2 * | 1/2005 | Iguchi | 345/204 |
| 6,992,663 | B2 * | 1/2006 | Nakamura et al. | 345/204 |
| 7,268,332 | B2 * | 9/2007 | Yamazaki | 250/208.1 |
| 7,397,448 | B2 * | 7/2008 | Stevenson et al. | 345/76 |
| 7,592,975 | B2 * | 9/2009 | Yamazaki et al. | 345/60 |
| 7,679,585 | B2 * | 3/2010 | Kimura | 345/76 |
| 2003/0016191 | A1 * | 1/2003 | Nakamura et al. | 345/55 |
| 2003/0020705 | A1 * | 1/2003 | Kondo et al. | 345/212 |
| 2004/0004443 | A1 * | 1/2004 | Park et al. | 315/169.1 |
| 2004/0032380 | A1 * | 2/2004 | Kanauchi | 345/63 |
| 2004/0090186 | A1 * | 5/2004 | Yoshida et al. | 315/169.1 |
| 2005/0017931 | A1 * | 1/2005 | Toyoshima et al. | 345/76 |
| 2005/0134189 | A1 * | 6/2005 | Osame et al. | 315/169.1 |
| 2005/0243079 | A1 * | 11/2005 | Ozaki | 345/204 |

FOREIGN PATENT DOCUMENTS

| | | |
|---|---|---|
| JP | 2000-221903 | 8/2000 |
| JP | 2002-023697 | 1/2002 |
| JP | 2003-76327 | 3/2003 |
| JP | 2004-46130 | 2/2004 |

(Continued)

OTHER PUBLICATIONS

Patent Abstracts of Japan for Publication No. 2005-195777; dated Jul. 21, 2005, in the name of Takayoshi Yoshida.

(Continued)

*Primary Examiner* — Gregory J Tryder
(74) *Attorney, Agent, or Firm* — Christie, Parker & Hale, LLP

(57) ABSTRACT

A pixel circuit of an organic light emitting diode (OLED) display device is provided, which supplies a small current to an organic light emitting diode during stoppage of a display operation. The pixel circuit includes a second driving transistor, which is coupled in parallel with a first driving transistor. A gate control line is used to control the second driving transistor so that a small current can flow into the organic light emitting diode during the stoppage of the display operation. The small current is supplied through the second driving transistor to the organic light emitting diode during the stoppage of the display operation. Thus, the pixel circuit of the OLED display device can reduce or prevent an electric shock applied to the organic light emitting diode at the beginning of the display operation, thereby reducing or preventing deterioration of the characteristics of the organic light emitting diode.

19 Claims, 5 Drawing Sheets

(56) References Cited

FOREIGN PATENT DOCUMENTS

| | | | | |
|---|---|---|---|---|
| JP | 2005-195777 | | 7/2005 | |
| KR | 2003-0044567 | | 6/2003 | |
| KR | 10-0489166 | | 5/2005 | |
| WO | WO 2004097782 | A1 * | 11/2004 | ..... G09G 3/32 |

OTHER PUBLICATIONS

Patent Abstracts of Japan for Publication No. 2004-046130; dated Feb. 12, 2004, in the name of Hajime Kimura.

Patent Abstracts of Japan for Publication No. 2002-23697; dated Jan. 23, 2002, in the name of Kazutaka Inukai.

Patent Abstracts of Japan, Publication No. 2000-221903, Published on Aug. 11, 2000, in the name of Furumiya, et al.

Patent Abstracts of Japan, Publication No. 2003-076327, Published on Mar. 14, 2003, in the name of Iguchi.

Korean Patent Abstracts, Publication No. 1020030044567 A, Published on Jun. 9, 2003, in the name of Jung.

Korean Patent Abstracts, Publication No. 1020040079167 A, Published on Sep. 14, 2004, in the name of Kim, et al. Corresponding to Korean Patent No. 10-0489166.

* cited by examiner

PIXEL CIRCUIT AND ORGANIC LIGHT EMITTING DIODE DISPLAY DEVICE USING THE SAME

CROSS-REFERENCE TO RELATED APPLICATION

This application claims priority to and the benefit of Korean Patent Application No. 10-2005-0126353, filed in the Korean Intellectual Property Office on Dec. 20, 2005, the entire content of which is incorporated herein by reference.

BACKGROUND OF THE INVENTION

1. Field of the Invention

The present invention relates to an organic light emitting diode (OLED) display device and, more particularly, to a pixel circuit of an OLED display device.

2. Description of the Related Art

Among flat panel displays (FPDs), an organic light emitting diode (OLED) display device is quite appropriate for displaying moving images irrespective of size because it has a fast response time of 1 ms or less, consumes low power, and is an self-emissive display, therefore having a wide viewing angle. Also, the OLED display device can be fabricated at a low temperature and in a simple process based on conventional semiconductor manufacturing technology. For these reasons, the OLED display device has attracted considerable attention as an advanced FPD.

In general, the OLED display device is a display device that emits light by electrically exciting a fluorescent organic compound, and displays an image by voltage programming or current programming N×M organic light emitting diodes (OLEDs) arranged in a matrix. The OLED display device may be classified as a passive matrix type or an active matrix type using a thin film transistor (TFT) depending on a driving method. The passive matrix type OLED display device includes anodes and cathodes arranged at right angles, and is driven through line selection. On the other hand, the active matrix type OLED display device has a TFT connected to each pixel electrode, formed of indium tin oxide (ITO), and is driven according to a voltage maintained by a capacitor connected to a gate of the TFT.

FIG. 1 is a circuit diagram of a pixel circuit of a conventional OLED display device.

Referring to FIG. 1, the pixel circuit includes a switching transistor MS, a capacitor Cgs for storing a data signal received through the switching transistor MS, a driving transistor MD for generating a driving current in response to the data signal stored in the capacitor Cgs, and an OLED that emits light in response to the driving current.

The switching transistor MS transmits a data signal output from a data line Dm in response to a scan signal output from a scan line Sn. The capacitor Cgs stores a data signal received through the switching transistor MS and maintains a gate-source voltage Vgs of the driving transistor MD for a predetermined duration of time. A gate electrode of the driving transistor MD is connected to the switching transistor MS. The driving transistor MD supplies a driving current corresponding to the data signal transmitted through the switching transistor MS to the OLED. The OLED includes an anode, a cathode, and an emission layer interposed between the anode and the cathode. The anode is connected to a drain terminal of the driving transistor MD and coupled to a power supply voltage line Vdd through the driving transistor MD. The cathode is connected to a reference voltage line Vss and emits light with a brightness corresponding to the current supplied from the driving transistor MD.

In the OLED, holes transported from the anode combine with electrons transported from the cathode in an organic layer to form hole-electron pairs, i.e., excitons, and light is emitted by the energy generated when the excitons transition from an excited state to a ground state.

When the OLED display device including the above-described OLED begins a display operation, a high voltage is applied to a display panel in a short period of time. Thus, a large current is supplied to the OLED suddenly. As a result, sudden transport of a large number of holes and electrons electrically shocks an organic layer of the OLED, so that the characteristics of the OLED may deteriorate.

SUMMARY OF THE INVENTION

An exemplary embodiment of the present invention provides a pixel circuit of an organic light emitting diode (OLED) display device, which relieves an electric shock applied to an organic light emitting diode at the beginning of driving the display to prevent the characteristics of the organic light emitting diode from deteriorating.

In an exemplary embodiment of the present invention, a pixel circuit of an OLED display device having scan lines, data lines, and pixel regions defined by the scan lines and the data lines includes: a switching transistor for performing a switching operation in response to a scan signal from a corresponding one of the scan lines; a capacitor for storing a data signal received from a corresponding one of the data lines through the switching transistor; a first driving transistor for generating a first driving current in response to the data signal stored in the capacitor; a second driving transistor coupled in parallel with the first driving transistor and adapted to be turned on during stoppage of a display operation to generate a second driving current; and an organic light emitting diode for performing a light emission operation according to at least one of the first driving current or the second driving current.

In another exemplary embodiment of the present invention, an OLED display device includes: a display panel including pixel circuits disposed at pixel regions defined by data lines and scan lines to display an image; a scan driver for transmitting a scan signal on the scan lines to select one of the pixel circuits; a data driver for transmitting a data signal on the data lines; a power supply for applying a voltage to the scan driver, the data driver, and the display panel; and a controller for controlling the scan driver, the data driver, and the power supply and controlling operations of the pixel circuits through a gate control line during stoppage of a display operation. At least one of the pixel circuits includes a switching transistor for performing a switching operation in response to the scan signal, a capacitor for storing the data signal received through the switching transistor, a first driving transistor for generating a first driving current in response to the data signal stored in the capacitor, a second driving transistor coupled in parallel with the first driving transistor and adapted to be turned on in response to a control signal of the gate control line during the stoppage of the display operation to generate a second driving current, and an organic light emitting diode for performing a light emission operation according to at least one of the first driving current or the second driving current.

In yet another exemplary embodiment, a method of driving an organic light emitting diode display device is provided. The organic light emitting display device includes a plurality of pixel circuits, each of the pixel circuits including a switch, a capacitor, and a light emitting element. The method includes: storing a data signal received through the switch in the capacitor; providing a first current to the light emitting element via a first current path between a power source and the light emitting element to emit light corresponding to the data signal; and providing a second current to the light emitting element via a second current path between the power source and the light emitting element.

BRIEF DESCRIPTION OF THE DRAWINGS

The above and other features of the present invention will be described in reference to certain exemplary embodiments thereof with reference to the attached drawings in which.

DETAILED DESCRIPTION

The present invention will now be described more fully hereinafter with reference to the accompanying drawings, in which exemplary embodiments of the invention are shown.

Embodiment 1

Figure 1:
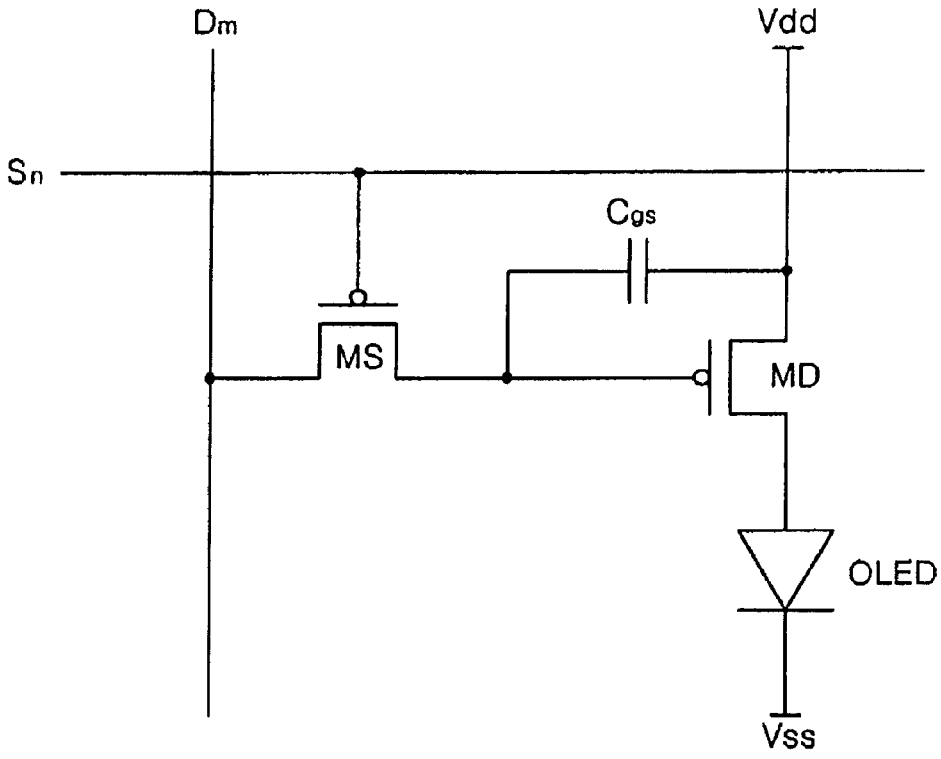
FIG. 1 is a circuit diagram of a pixel circuit of a conventional organic light emitting diode (OLED) display device.
Figure 2:
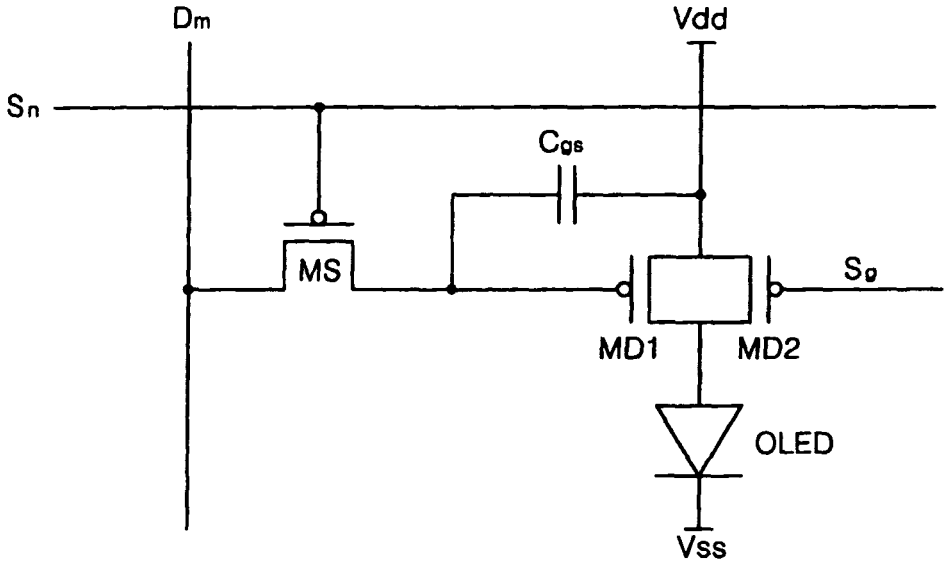
FIG. 2 is a circuit diagram of a pixel circuit of an OLED display device according to an exemplary embodiment of the present invention.

FIG. 2 is a circuit diagram of a pixel circuit of an OLED display device according to an exemplary embodiment of the present invention.

Referring to FIG. 2, the pixel circuit includes a switching transistor MS, a capacitor Cgs for storing a data signal received through the switching transistor MS, a first driving transistor MD1 for generating a first driving current in response to the data signal stored in the capacitor Cgs, a second driving transistor MD2, which is turned on in response to the control signal of the gate control line Sg during the stoppage of the display operation and generates a second driving current, and an organic light emitting diode for performing a light emission operation in response to the first driving current or the second driving current.

The switching transistor MS transmits the data signal output from the data line Dm in response to the scan signal output from the scan line Sn. The capacitor Cgs stores the data signal received through the switching transistor MS and maintains a gate-source voltage Vgs of the first driving transistor MD1 for a period of time (e.g., a predetermined duration of time).

A drain electrode of the switching transistor MS is connected to a gate electrode of the first driving transistor MD1, a power supply voltage line Vdd is connected to a first electrode of the first driving transistor MD1, and a second electrode of the first driving transistor MD1 is connected to an anode of the organic light emitting diode. Thus, the first driving transistor MD1 generates the first driving current corresponding to the data signal transmitted through the switching transistor MS and stored in the capacitor Cgs, and supplies the first driving current to the organic light emitting diode.

The second driving transistor MD2 is turned on at the stoppage of the display operation and allows a small current to flow into the organic light emitting diode. Thus, the second driving transistor MD2 is connected in parallel to the first driving transistor MD1. The gate control line Sg is connected to a gate electrode of the second driving transistor MD2 so that the second driving transistor MD2 is turned on/off in response to the control signal of the gate control line Sg. A first electrode of the second driving transistor MD2 is connected to the power supply voltage line Vdd, and a second electrode of the second driving transistor MD2 is connected to the anode of the organic light emitting diode. Thus, at the stoppage of the display operation, when a low-level control signal Sg is applied through the gate control line Sg, the second driving transistor MD2 is turned on, and generates and then outputs a second driving current corresponding to the low-level control signal Sg to the organic light emitting diode.

The organic light emitting diode includes an anode, a cathode, and an emission layer interposed between the anode and the cathode. The anode is connected to the second electrodes of the first and second driving transistors MD1 and MD2 and coupled to the power supply voltage line Vdd through the first and second driving transistors MD1 and MD2, and the cathode is connected to a reference voltage line Vss.

In one embodiment, when the first driving transistor MD1 operates, the second driving transistor MD2 is turned off, and when the first driving transistor MD1 is turned off, the second driving transistor MD2 operates.

Accordingly, during driving of the display, the first driving current generated by the first driving transistor MD1 is supplied to the organic light emitting diode, and at the stoppage of the display operation (i.e., when the display operation has stopped), the second driving current generated by the second driving transistor MD2 is supplied to the organic light emitting diode. The organic light emitting diode emits light with a brightness corresponding to the driving current.

In one embodiment, the second driving current reaches 0.01% to 1% of the average of the current flowing through the organic light emitting diode during driving the display (i.e., the first driving current). In one embodiment, when the second driving current is less than 0.01% of the average of the first driving current, a current flowing through the organic light emitting diode is too small to sufficiently relieve an electric shock. On the other hand, in one embodiment, when the second driving current is more than 1% of the average of the first driving current, the brightness of the organic light emitting diode is too high so that a user may sense light emitted by the organic light emitting diode even at the stoppage.

In one embodiment, a channel width/length (W1/L1) ratio of the first driving transistor MD1 may be greater than a channel width/length (W2/L2) ratio of the second driving transistor MD2.

The first driving transistor MD1 generates the first driving current in response to the data signal so that the organic light emitting diode emits light with a brightness corresponding to the first driving current. At this time, due to the leakage current of the turned-off second driving transistor MD2, a current larger than the first driving current is generally supplied to the organic light emitting diode. As a result, the organic light emitting diode emits light with a brightness higher than desired. In general, as the width W of a channel of a TFT increases, a leakage current increases, while as the length L of the channel of the TFT increases, the leakage current decreases. Therefore, when the channel width/length (W1/L1) ratio of the first driving transistor MD1 is greater than the channel width/length (W2/L2) ratio of the second driving transistor MD2, the leakage current of the second driving transistor MD2 decreases, so that the brightness of the organic light emitting diode can be controlled more precisely.

Embodiment 2

Figure 3:
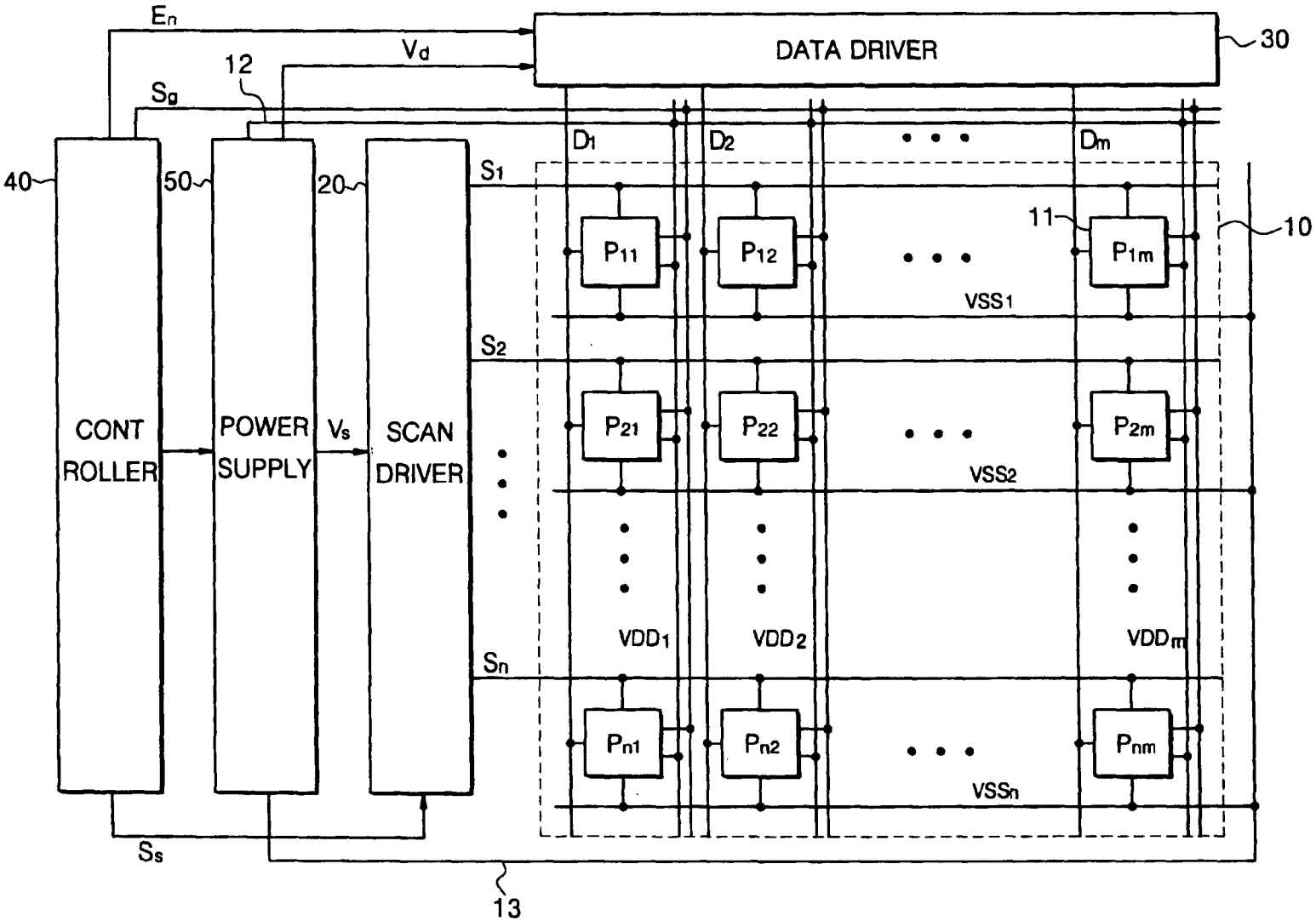
FIG. 3 is a block diagram of an OLED display device using the pixel circuit according to the exemplary embodiment of the present invention shown in FIG. 2.

FIG. 3 is a block diagram of an OLED display device using the pixel circuit according to the above embodiment.

Referring to FIG. 3, the OLED display device according to an embodiment of the present invention includes a display panel 10, a scan driver 20, a data driver 30, a controller 40, and a power supply 50.

The controller 40 outputs a control signal to the scan driver 20, the data driver 30, and the power supply 50. Also, the controller 40 controls the operation of pixel circuits P11-Pnm disposed in the display panel 10 through a gate control line Sg during stoppage of a display operation.

The power supply 50 outputs a voltage required for operating the scan driver 20, the data driver 30, and the display panel 10 according to the driving control of the controller 40.

The scan driver 20 outputs a scan signal to scan lines S1-Sn connected to the scan driver 20 in response to the control signal output from the controller 40. Thus, the pixel circuits P11-Pnm disposed in the display panel 10 are selected in response to the scan signal.

The data driver 30 is synchronized with the scan signal output from the scan driver 20 in response to the control signal of the controller 40 and transmits data signals to the corresponding pixel circuits P11-Pnm through data lines D1-Dm connected to the data driver 30. Thus, the display panel 10 emits light from the pixel circuits P11-Pnm in response to the data signals and displays an image.

Figure 4:
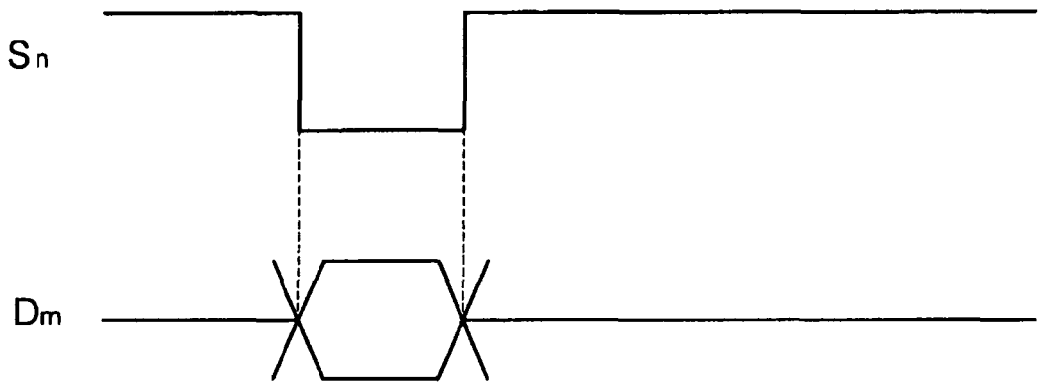
FIG. 4 is a timing diagram illustrating the operation of the OLED display device shown in FIG. 2 during driving the display.
Figure 5:
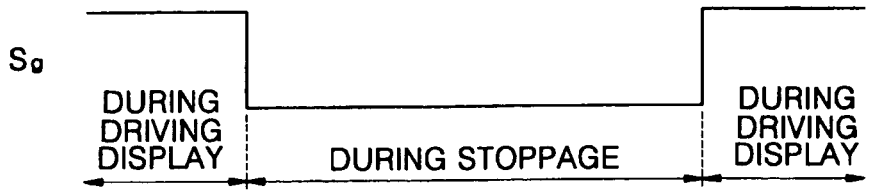
FIGS. 5 and 6 are timing diagrams illustrating the operation of the OLED display device shown in FIG. 2 during the stoppage of the display operation.
Figure 6:
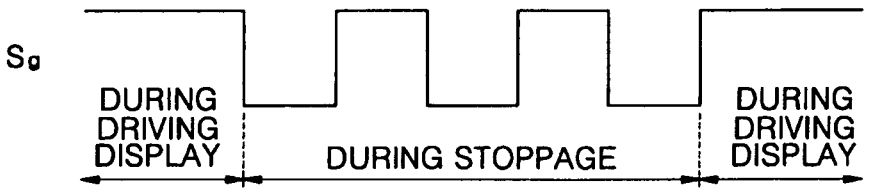

Hereinafter, the operation of the OLED display device shown in FIG. 3 will be described with reference to FIG. 4 through 6. FIG. 4 is a timing diagram illustrating the operation of the pixel circuit of the OLED display device shown in FIG. 2 during driving the display, and FIGS. 5 and 6 are timing diagrams illustrating the operation of the pixel circuit of the OLED display device shown in FIG. 2 during the stoppage of the display operation.

Referring to FIGS. 2, 3, and 4, during driving the display, a control signal is first transmitted from the controller 40 to the scan driver 20, the data driver 30, and the power supply 50. The power supply 50, which receives the control signal, outputs a voltage to the scan driver 20, the data driver 30, and a power supply voltage line 12 and a reference voltage line 13 of the display panel 10.

The scan driver 20 outputs a scan signal to the scan lines S1-Sn connected to the scan driver 20 in response to the control signal output from the controller 40. Also, the data driver 30 is synchronized with the scan signal output from the scan driver 20 in response to the control signal output from the controller 40 and transmits data signals to corresponding pixel circuits 11 through the data lines D1-Dm connected to the data driver 30.

The switching transistor MS of each of the pixel circuits 11 transmits the data signal from the data line Dm to the first driving transistor MD1 in response to the scan signal transmitted from the scan line Sn. The first driving transistor MD1, which receives the data signal, is turned on and supplies a first driving current corresponding to the data signal to the organic light emitting diode, so that the display panel 10 displays an image. The controller 40 transmits a high-level control signal to the gate control line Sg, and thus the second driving transistor MD2 is turned off.

Referring to FIGS. 2, 3, and 5, at the stoppage of the display operation, when the controller 40 transmits a control signal to the power supply 50, the power supply 50 applies a predetermined voltage to the power supply voltage line 12 and the reference voltage line 13. Also, the controller 40 transmits a low-level control signal to the gate control line Sg. The second driving transistor MD2 is turned on in response to the low-level control signal and supplies a second driving current corresponding to the control signal to the organic light emitting diode. When the second driving current is supplied to the organic light emitting diode, the scan driver 20 and the data driver 30 remain turned off, and the switching transistor MS and the first driving transistor MD1 are also turned off.

In one embodiment, the controller 40 may transmit the control signal such that the second driving current reaches 0.01% to 1% of the average of the current flowing through the organic light emitting diode during driving the display (i.e., the first driving current). In one embodiment, when the second driving current is less than 0.01% of the average of the first driving current, a current flowing through the organic light emitting diode is too small to sufficiently relieve an electric shock. On the other hand, in one embodiment, when the second driving current is more than 1% of the average of the first driving current, the brightness of the organic light emitting diode is too high so that a user may sense light emitted by the organic light emitting diode even at the stoppage.

In the above-described operation, as shown in FIG. 5, a low-level control signal Sg is continuously transmitted to the gate electrode of the second driving transistor MD2 during the stoppage of the display operation, so that the second driving current can keep flowing into the organic light emitting diode.

On the other hand, referring to FIG. 6, the above-described operation may be repeated at regular intervals during the stoppage of the display operation. In other words, a low-level control signal Sg is transmitted to the gate electrode of the second driving transistor MD2 at regular intervals during the stoppage, and thus the second driving current can flow into the organic light emitting diode at regular intervals.

The transistors MS, MD1 and MD2 may be a same conductivity type transistor (e.g., P-channel metal oxide semiconductor (PMOS) TFT or N-channel metal oxide semiconductor (NMOS) TFT). In the present exemplary embodiment, it is exemplarily described on the assumption that the transistors MS, MD1 and MD2 are PMOS transistors. However, the invention is not limited thereto. Further, by way of example, the pixel circuit in other embodiments may include other PMOS TFTs and/or NMOS TFTs.

As described above, the pixel circuit of the organic light emitting display device according to exemplary embodiments of the present invention includes the second driving transistor, which is connected in parallel to the first driving transistor and turned on during the stoppage of the display operation so that a small current can flow into the organic light emitting diode at regular intervals or incessantly. Thus, an electric shock applied to the organic light emitting diode due to a sudden transport of a large number of holes and electrons can be reduced during the display operation. As a result, exemplary embodiments of the present invention can prevent the characteristics of the organic light emitting diode from deteriorating, thus increasing the lifetime of the organic light emitting display device.

As explained thus far, a pixel circuit of an organic light emitting display device according to exemplary embodiments of the present invention can relieve an electric shock applied to an organic light emitting diode at the beginning of driving a display to prevent the characteristics of the organic light emitting diode from deteriorating. Thus, the lifetime of the organic light emitting display device can be extended.

Although the present invention has been described with reference to certain exemplary embodiments thereof, it will be understood by those skilled in the art that a variety of modifications and variations may be made to the present invention without departing from the spirit or scope of the present invention defined in the appended claims, and their equivalents.

What is claimed is:

1. A pixel circuit of an organic light emitting diode (OLED) display device comprising scan lines, data lines, gate control lines, a power supply, and pixel regions defined by the scan lines and the data lines, the pixel circuit comprising:

a switching transistor for performing a switching operation in response to a scan signal from a corresponding one of the scan lines;

a capacitor for storing a data signal received from a corresponding one of the data lines through the switching transistor;

a first driving transistor for generating a first driving current in response to the data signal stored in the capacitor;

a second driving transistor coupled in parallel with the first driving transistor and adapted to be turned on and off in response to a control signal from a corresponding one of the gate control lines transmitted at intervals during stoppage of a display operation to generate an intermittent second driving current; and an organic light emitting diode for performing a light emission operation according to the first driving current flowing through the organic light emitting diode during the display operation and according to the second driving current flowing through the second driving transistor and the organic light emitting diode during the stoppage of the display operation, wherein the control signal varies between first and second levels during an operation of the pixel circuit, wherein a first electrode of the first driving transistor is connected to a first electrode of the second driving transistor, and wherein a second electrode of the first driving transistor and a second electrode of the second driving transistor are connected to an anode of the organic light emitting diode.

2. The pixel circuit according to claim 1, wherein the second driving transistor is adapted to be turned off when the first driving transistor operates, and the second driving transistor is adapted to operate when the first driving transistor is turned off.

3. The pixel circuit according to claim 2, wherein the second driving current is 0.01% to 1% of an average of the first driving current.

4. The pixel circuit according to claim 1, wherein the first driving transistor has a larger channel width/length ratio than the second driving transistor.

5. An organic light emitting diode (OLED) display device comprising scan lines, data lines, gate control lines coupled to a controller, a power supply, and pixel circuits disposed at regions defined by the scan lines and the data lines, at least one of the pixel circuits comprising:

a switching transistor for performing a switching operation in response to a scan signal from a corresponding one of the scan lines;

a capacitor for storing a data signal received from a corresponding one of the data lines through the switching transistor;

a first driving transistor for generating a first driving current in response to the data signal stored in the capacitor;

a second driving transistor coupled in parallel with the first driving transistor and adapted to be turned on and off in response to a control signal from the controller transmitted at intervals through a corresponding one of the gate control lines during stoppage of a display operation to generate an intermittent second driving current; and an organic light emitting diode for performing a light emission operation according to the first driving current flowing through the organic light emitting diode during the display operation and according to the second driving current flowing through the second driving transistor and the organic light emitting diode during the stoppage of the display operation, wherein the controller is configured to vary a voltage of the control signal between first and second levels, wherein a first electrode of the first driving transistor is connected to a first electrode of the second driving transistor, and wherein a second electrode of the first driving transistor and a second electrode of the second driving transistor are connected to an anode of the organic light emitting diode.

6. The OLED display device according to claim 5, wherein the second driving transistor is adapted to be turned off when the first driving transistor operates, and the second driving transistor is adapted to operate when the first driving transistor is turned off.

7. The OLED display device according to claim 6, wherein the second driving current is 0.01% to 1% of an average of the first driving current.

8. The OLED Display Device according to claim 5, wherein the first driving transistor has a larger channel width/length ratio than the second driving transistor.

9. An organic light emitting diode (OLED) display device comprising:

a display panel comprising pixel circuits disposed at pixel regions defined by data lines and scan lines to display an image;

a scan driver for transmitting a scan signal on the scan lines to select one of the pixel circuits;

a data driver for transmitting a data signal on the data lines;

a power supply for applying a voltage to the scan driver, the data driver, and the display panel; and a controller for controlling the scan driver, the data driver, and the power supply, and for providing a control signal that varies between first and second levels to control operations of the pixel circuits through a gate control line during stoppage of a display operation, wherein at least one of the pixel circuits comprises a switching transistor for performing a switching operation in response to the scan signal, a capacitor for storing the data signal received through the switching transistor, a first driving transistor for generating a first driving current in response to the data signal stored in the capacitor during the display operation, a second driving transistor coupled in parallel with the first driving transistor and adapted to be turned on and off in response to the control signal of the gate control line transmitted at intervals during the stoppage of the display operation to generate an intermittent second driving current, and an organic light emitting diode for performing a light emission operation according to the first driving current flowing through the organic light emitting diode and according to the second driving current flowing through the second driving transistor and the organic light emitting diode, wherein a first electrode of the first driving transistor is connected to a first electrode of the second driving transistor, and wherein a second electrode of the first driving transistor and a second electrode of the second driving transistor are connected to an anode of the organic light emitting diode.

10. The OLED display device according to claim 9, wherein a gate electrode of the second driving transistor is coupled to the gate control line.

11. The OLED display device according to claim 10, wherein the gate control line is configured to transmit the control signal having a low level as the second level to the second driving transistor during the stoppage of the display operation.

12. The OLED display device according to claim 11, wherein the gate control line is configured to transmit the low-level control signal to the second driving transistor at regular intervals during the stoppage of the display operation.

13. The OLED display device according to claim 9, wherein the first driving transistor has a larger channel width/length ratio than the second driving transistor.

14. The OLED display device according to claim 9, wherein the second driving current is 0.01% to 1% of an average of the first driving current.

15. The OLED display device according to claim 9, wherein the switching transistor and the first and second driving transistors are transistors having a same conductivity type.

16. The OLED Display Device according to claim 15, wherein the switching transistor and the first and second driving transistors are P-channel Metal Oxide Semiconductor (PMOS) transistors or N-channel Metal Oxide Semiconductor (NMOS) transistors.

17. A method of driving an organic light emitting diode display device comprising a plurality of pixel circuits, each of the pixel circuits comprising a switch, a capacitor, and a light emitting element, the method comprising:

storing a data signal received through the switch in the capacitor;

providing a first current to the light emitting element through a first transistor via a first current path between a power source and the light emitting element to emit light corresponding to the data signal during a display operation; and providing an intermittent second current to the light emitting element through a second transistor via a single second current path between the power source and the light emitting element by providing a control signal through a gate control line at intervals during a stoppage of the display operation, wherein the control signal varies between first and second levels during an operation of the organic light emitting diode display device, wherein a first electrode of the first transistor is connected to a first electrode of the second transistor, and wherein a second electrode of the first transistor and a second electrode of the second transistor are connected to an anode of the organic light emitting diode.

18. The method according to claim 17, wherein the first current path comprises the first transistor having the capacitor coupled between its gate electrode and a source or drain electrode, and the second current path comprises the second transistor coupled in parallel with the first transistor.

19. The method according to claim 17, wherein providing the second current comprises providing the second current while the first current is not provided.

* * * * *